United States Patent [19]

Guth et al.

[11] 4,408,995

[45] Oct. 11, 1983

[54] PROCESS FOR DYEING OR FINISHING TEXTILE FIBRE MATERIALS WITH FOAMED AQUEOUS LIQUOR CONTAINING ETHYLENE OXIDE-PROPYLENE OXIDE BLOCK CO-POLYMER

[75] Inventors: Christian Guth, Basel; Jörg Binz, Reinach, both of Switzerland

[73] Assignee: Ciba-Geigy Corporation, Ardsley, N.Y.

[21] Appl. No.: 346,981

[22] Filed: Feb. 8, 1982

[30] Foreign Application Priority Data

Feb. 11, 1981 [CH] Switzerland ..... 903/81

[51] Int. Cl.[3] ..... D06L 3/12; D06B 1/14

[52] U.S. Cl. ..... 8/477; 8/115.5; 8/552; 8/680; 8/904; 8/929

[58] Field of Search ..... 8/477, 904, 552, 115.5

[56] References Cited

U.S. PATENT DOCUMENTS

| | | | |
|---|---|---|---|
| 2,971,458 | 2/1961 | Kumins et al. | 8/477 |
| 3,762,860 | 10/1973 | Abrahams et al. | 8/477 |
| 3,913,359 | 10/1975 | Childers et al. | 68/183 |
| 3,990,840 | 11/1976 | von der Eltz et al. | 8/477 |
| 4,099,913 | 7/1978 | Walter et al. | 8/477 |
| 4,118,526 | 10/1978 | Gregorian et al. | 8/477 |
| 4,193,762 | 3/1980 | Nambordi | 8/151 |
| 4,198,204 | 4/1980 | von der Eltz et al. | 8/543 |
| 4,270,915 | 6/1981 | Johnson et al. | 8/477 |
| 4,347,145 | 8/1982 | Gregorian et al. | 8/477 |
| 4,365,967 | 12/1982 | Guth et al. | 8/477 |

FOREIGN PATENT DOCUMENTS

| | | |
|---|---|---|
| 9721 | 9/1979 | European Pat. Off. . |
| 2027753 | 2/1980 | United Kingdom . |

*Primary Examiner*—A. Lionel Clingman

*Attorney, Agent, or Firm*—Edward McC. Roberts

[57] ABSTRACT

A process for dyeing or finishing textile fibre material using foam, which process comprises applying to said materials an aqueous foam composition which, in addition to containing dye or finishing agent, contains a foamable system comprising water and at least (A) an anionic surfactant and (B) a non-ionic block polymer based on ethylene oxide and propylene oxide units.

The material is then dried, if desired, and then subjected to a heat treatment, preferably a steam treatment. Level dyeings with good penetration of dye and/or excellent finishes are obtained on the material.

27 Claims, No Drawings

PROCESS FOR DYEING OR FINISHING TEXTILE FIBRE MATERIALS WITH FOAMED AQUEOUS LIQUOR CONTAINING ETHYLENE OXIDE-PROPYLENE OXIDE BLOCK CO-POLYMER

The present invention relates to a continuous process for dyeing or finishing textile fibre materials, preferably of marked three-dimensional character (pile goods) and especially carpets, using foam, and to the textile material dyed or finished by said process.

The process of this invention comprises applying to the materials a foamed aqueous composition which, in addition to containing the dye (or fluorescent whitening agent) or the finishing agent, contains a foamable system comprising water and at least (A) one anionic surfactant and (B) one non-ionic block polymer which is based on ethylene oxide and propylene oxide units, if desired drying said materials, and subsequently subjecting them to a heat treatment.

Components (A) and (B) may be employed as individual compounds or in admixture. Component (A) is the actual foaming agent which acts simultaneously also as foam regulator and foam stabiliser. On the hand it is able, in very small amount, to form the foam in sufficient amount and, on the other, to regulate and stabilise the foam.

The anionic surfactants (A) are preferably derivatives of alkylene oxide adducts, e.g. adducts of alkylene oxides, preferably of ethylene oxide and/or propylene oxide and also styrene oxide, with organic hydroxyl, carboxyl, amino and/or amido compounds containing aliphatic hydrocarbon radicals having a total of at least 4 carbon atoms, or mixtures of such compounds, which adducts contain acid ether groups or, preferably, acid ester groups of inorganic or organic acids. These acid ethers or esters can be in the form of the free acids or salts, e.g. alkali metal salts, alkaline earth metal salts, ammonium or amine salts.

These anionic surfactants are obtained by known methods, by addition of at least 1 mole, preferably of more than 1 mole, e.g. 2 to 60 moles, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Examples of suitable anionic surfactants are:

sulfated aliphatic alcohols which contain 8 to 18 carbon atoms in the alkyl chain, e.g. sulfated lauryl alcohol;

sulfated unsaturated fatty acids or fatty acid lower alkyl esters which contain 8 to 20 carbon atoms in the fatty radical, e.g. ricinic acid and oils containing such fatty acids, e.g. castor oil;

alkylsulfonates containing 8 to 20 carbon atoms in the alkyl chain, e.g. dodecylsulfonate;

alkylarylsulfonates with linear or branched alkyl chain containing at least 6 carbon atoms, e.g. dodecylbenzenesulfonates or 3,7-diisobutylnaphthalenesulfonates;

sulfonates of polycarboxylic acid esters, e.g. dioctylsulfosuccinates or sulfosuccinamides;

the alkali metal salts, ammonium salts or amine salts of fatty acids containing 10 or 20 carbon atoms, e.g. rosin salts, classified as soaps;

esters of polyalcohols, especially mono- or diglycerides of fatty acids containing 12 to 18 carbon atoms, e.g. monoglycerides of lauric, stearic or oleic acid; and the adducts of 1 to 60 moles of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alkanols containing 3 to 6 carbon atoms, which adducts are converted into an acid ester with an organic dicarboxylic acid, e.g. maleic acid, malonic acid or sulfosuccinic acid, but preferably with an inorganic polybasic acid such as o-phosphoric acid or in particular, sulfuric acid.

Very suitable anionic surfactants (A) are acid esters, or salts thereof, of a polyadduct of 2 to 30 moles of ethylene oxide with 1 mole of a fatty alcohol containing 8 to 22 carbon atoms, or with 1 mole of a phenol which contains at least one benzyl group, one phenyl group or preferably one alkyl group containing at least 4 carbon atoms, e.g. benzylphenol, dibenzylphenol, dibenzyl-(nonyl)phenol, o-phenylphenol, butylphenol, tributylphenol, octylphenol, nonylphenol, dodecylphenol or pentadecylphenol, which acid esters may be used individually or in admixture.

Preferred components (A) have the formula $$R-O-(CH_2CH_2O)_m-X, \quad (1)$$

wherein R is alkyl or alkenyl, each of 8 to 22 carbon atoms, alkylphenyl containing 4 to 16 carbon atoms in the alkyl moiety, or o-phenylphenyl, X is the acid radical of an inorganic oxygen-containing acid, e.g. sulfuric acid or phosphoric acid, or is also the radical of an organic acid, and m is 2 to 30, preferably 2 to 15. The alkyl moiety of alkylphenyl is preferably in the para-position, and can be butyl, hexyl, n-octyl, n-nonyl, p-tert-octyl, p-isononyl, decyl or dodecyl. Preferred alkyl radicals are those containing 8 to 12 carbon atoms, with octyl and nonyl being most preferred.

The fatty alcohols for obtaining the anionic surfactants of the formula (1) are e.g. those containing 8 to 22, preferably 8 to 18, carbon atoms, such as octyl, decyl, lauryl, tridecyl, myristyl, cetyl, stearyl, oleyl, arachidyl or behenyl alcohol.

The acid radical X is derived, for example, from a low molecular dicarboxylic acid, e.g. from maleic acid, succinic acid or sulfosuccinic acid, and is linked to the oxyethylene part of the molecule through an ester bridge. In particular, X is derived from an inorganic polybasic acid such as orthophosphoric acid and sulfuric acid. The acid radical X can be in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Particularly preferred components (A) are anionic surfactants of the formula

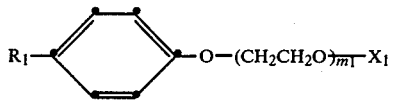

(2)

wherein $R_1$ is octyl or nonyl, $m_1$ is 2 to 15, and $X_1$ is derived from o-phosphoric acid or, preferably, from sulfuric acid, which surfactants are in the form of free acids or sodium or ammonium salts. A particularly preferred anionic surfactant is the acid sulfuric acid ester of the adduct of 2 to 12 moles of ethylene oxide with 1 mole of p-nonylphenol.

The anionic surfactants (A) may be used by themselves, as mixtures with one another, or also in combination with a non-ionic ethylene oxide polyadduct.

The non-ionic ethylene oxide polyadduct is advantageously an adduct of 1 to 100 moles of alkylene oxide and 1 mole of an aliphatic monoalcohol containing at least 4 carbon atoms, of a trihydric to hexahydric aliphatic alcohol, of an unsubstituted or alkyl- or phenyl-substituted phenol, or of a fatty acid containing 8 to 22 carbon atoms.

The aliphatic monoalcohols employed for obtaining the nonionic polyadducts are e.g. water-insoluble monoalcohols containing at least 4, preferably 8 to 22, carbon atoms. These alcohols can be saturated or unsaturated and branched or straight-chain, and they can be employed individually or in admixture. It is possible to react natural alcohols, e.g. myristyl alcohol, cetyl alcohol, stearyl alcohol or oleyl alcohol, or synthetic alcohols such as, in particular, 2-ethylhexanol, and also trimethylhexanol, and also trimethylhexanol, trimethylnonyl alcohol, hexadecyl alcohol or $C_8$-$C_{22}$alfols, with the alkylene oxide. Alfols are linear primary alcohols of 8 to 22 carbon atoms. The number after the name indicates the average number of carbon atoms in the alcohol.

Examples of suitable unsubstituted or substituted phenols are phenol, o-phenylphenol or alkylphenols containing 1 to 16, preferably 4 to 12, carbon atoms, in the alkyl moiety. Examples of these alkylphenols are: p-cresol, butylphenol, tributylphenol, octylphenol and, in particular, nonylphenol.

The fatty acids contain preferably 8 to 12 carbon atoms and may be saturated or unsaturated, e.g. capric, lauric, myristic, palmitic or stearic acid, and decenoic, dodecenoic, tetradecenoic, hexadecenoic, oleic, linoleic, linolenic or, preferably, ricinolic acid.

Very suitable non-ionic surfactants are polyadducts of 2 to 15 moles of ethylene oxide and 1 mole of a fatty alcohol or fatty acid, each containing 8 to 22 carbon atoms, or 1 mole of an alkylphenol containing a total of 4 to 12 carbon atoms in the alkyl moiety; or fatty acid dialkanolamide containing 8 to 22 carbon atoms in the fatty acid moiety.

Instead of such polyadducts, there may also be used reaction products of a fatty acid containing 8 to 22 carbon atoms and a primary or secondary amine which contains at least one hydroxy-lower alkyl group or lower alkoxy-lower alkyl group, or alkylene oxide adducts of these hydroxyalkylated reaction products, the reaction being conducted such that the molecular ratio of hydroxyalkylamine to fatty acid can be 1:1 and greater than 1, e.g. 1.1:1 to 2:1, together with the anionic surfactant.

The amounts in which component (A) is added by itself or in admixture or with the ethylene oxide polyadduct to the treatment liquors vary from 0.5 to 5 g/l, preferably 1 to 3 g/l.

The polyethylene oxide/polypropylene oxide block polymers suitable for use as component (B) advantageously have a cloud point of 15° to 70° C., preferably of 25° to 50° C. The cloud point is determined in accordance with DIN 53 917. These block polymers advantageously contain 10 to 50% by weight of ethylene oxide units and 50 to 90% by weight of propylene oxide units and have a molecular weight of 250 to 6000, preferably of 350 to 3000.

Component (B) has the property of collapsing the foam under the action of moisture and heat, i.e. of causing it to deliquesce. This action results from the property of this component of having an especially pronounced cloud point in aqueous solution at 25° to 50° C., i.e. it has an antifoam action at elevated temperature. Component (B) acts as foam regulator in the steamer.

Suitable block polymers (B) have the formula

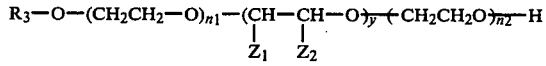

(3)

or

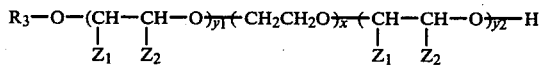

(4)

wherein $R_3$ is hydrogen, alkyl or alkenyl, each containing at most 18, preferably 8 to 16, carbon atoms, o-phenylphenyl or alkylphenyl containing 4 to 12 carbon atoms in the alkyl moiety, one of $Z_1$ and $Z_2$ is hydrogen and the other is methyl, y is 1 to 75, preferably 3 to 50 and x is 1 to 30, and the sum of $n_1+n_2$ is 3 to 30, preferably 3 to 15, and the sum of $y_1+y_2$ is 2 to 30, preferably 4 to 20, and $n_2$ and $y_2$ can also be 0.

Preferred components (B) are block polymers of the formula (3), wherein $R_3$ is alkyl or alkenyl, each of 4 to 18, preferably 8 to 16, carbon atoms, y is 1 to 15, preferably 3 to 15, $n_1$ is 3 to 15 and $n_2$ is 0.

Particularly useful block polymers are fatty alcohol polyglycol mixed ethers, especially polyadducts of 3 to 10 moles of ethylene oxide and 3 to 10 moles of propylene oxide with aliphatic monoalcohols, preferably alkanols, of 8 to 16 carbon atoms.

The following adducts are examples of alkylene oxide adducts of reaction products of the formula (3):

1. the polyadduct of 12 moles of ethylene oxide and 12 moles of propylene oxide with 1 mole of a $C_6$-$C_{18}$fatty alcohol, preferably lauryl alcohol, 2. the polyadduct of 5 moles of ethylene oxide and 5 moles of propylene oxide with 1 mole of alfol (12-14), 3. the polyadduct of 9.5 moles of ethylene oxide and 9.5 moles of propylene oxide with 1 mole of a $C_{12}$-$C_{14}$fatty alcohol, 4. the polyadduct of 9 moles of ethylene oxide and 7 moles of propylene oxide with 1 mole of a $C_{16}$-$C_{18}$fatty alcohol, 5. the polyadduct of 9.5 moles of ethylene oxide and 9.5 moles of propylene oxide with 1 mole of nonylphenol, 6. the block polymer having a molecular weight of 3250, 10% by weight hydrophilic, 7. the oxyethylated polypropylene glycol having a molecular weight of 1750, 65% hydrophilic (ethylene oxide), 8. the block polymer of 75 moles of propylene oxide and 25 moles of ethylene oxide, 9. the block polymer of 30 moles of propylene oxide and 5 moles of ethylene oxide.

The amounts in which component (B) is added by itself or in admixture to the treatment liquors vary from 0.1 to 5 g/l. Preferred foamable systems contain at least the following components:

(Aa) a sulfuric acid ester, or a salt thereof, of an adduct of 2 to 15 moles of ethylene oxide with 1 mole of an aliphatic monoalcohol containing 8 to 18 carbon atoms or, in particular, with 1 mole of an alkylphenol containing 4 to 12 carbon atoms in the alkyl moiety, and (Bb) a polyadduct of 3 to 10 moles of ethylene oxide and 3 to 10 moles of propylene oxide with an aliphatic monoalcohol containing 8 to 16 carbon atoms.

The foamable systems can be prepared by simply stirring components (A) and (B) with water. If desired, the foamable systems can be added in the form of one or more mixtures to the treatment liquors. The individual mixtures can act as foam regulator, foam stabiliser or wetting agent.

The weight ratio of component (A) to component (B) advantageously varies from 5:1 to 1:2, preferably from 3:1 to 1:1.

The foamable systems conveniently contain altogether, in each case based on the weight of the entire system:

5 to 60% by weight of component (A),
5 to 30% by weight of component (B), and
10 to 90% by weight of water.

The amounts in which the foamable systems are added to the treatment liquors range from 1 to 10 g, preferably from 1.5 to 5 g, per liter of liquor, depending on the method of dyeing or treatment.

The substrates to be treated in the practice of this invention can be made from all natural and/or synthetic fibrous materials, e.g. cotton, hemp, linen, jute, ramie, viscose-silk, viscose rayon, cellulose acetate (2½- or triacetate), polyester, polyacrylonitrile, polyamide 6 or 66, wool, silk, polypropylene, as well as fibre blends, e.g. blends of polyacrylonitrile/cotton, polyester/viscose, polyester/wool, polyamide/polyester and, in particular, polyester/cotton. Pile fabrics of polyamide, polyacrylonitrile, polyester, wool, cotton or the corresponding fibre blends are preferred. Carpet materials such as velvet pile or loop pile carpets of natural polyamide (wool) or, in particular, synthetic polyamide, are most preferred.

Depending on the substrate to be dyed, the usual classes of dye are suitable for the dyeing process of this invention, e.g. reactive dyes, substantive dyes, acid dyes, 1:1 or 1:2 metal complex dyes, disperse dyes, pigment dyes, vat dyes, basic dyes or coupling dyes.

Anionic dyes are preferred. These dyes are e.g. salts of monoazo, disazo or polyazo dyes which contain heavy metals or are preferably metal-free, including formazane dyes, as well as anthraquinone, xanthene, nitro, triphenylmethane, naphthoquinone-imine and phthalocyanine dyes. The anionic character of these dyes may be imparted by metal complex formation alone and/or preferably by acid salt-forming substituents such as carboxylic acid groups, sulfuric acid ester groups, phosphonic acid ester groups, and phosphonic acid groups or sulfonic acid groups. These dyes may also contain in the molecule reactive groups which form a covalent bond with the substrate to be dyed. Preferred dyes are the so-called acid metal-free dyes. These preferably contain only a single sulfonic acid group.

Interesting dyes are also the 1:1 or 1:2 metal complex dyes. The 1:1 metal complex dyes contain preferably one or two sulfonic acid groups. As metal they contain a heavy metal atom, e.g. copper, nickel or, preferably, chromium. Preferred metal complex dyes are 1:2 cobalt or 1:2 chromium complexes or monoazo dyes which contain acid amide or alkylsulfonyl groups or altogether a single sulfonic acid group.

Mixtures of at least two or three dyes can also be used in the process of this invention, in which case level and strong combination shade dyeings, including dichromatic or trichromatic dyeings, can be obtained. Trichromatic dyeing will be understood as meaning, in particular, a combination of the three basic colours: yellow (or orange), red and blue. A very useful blue component is, in particular, at least one dye of the formula

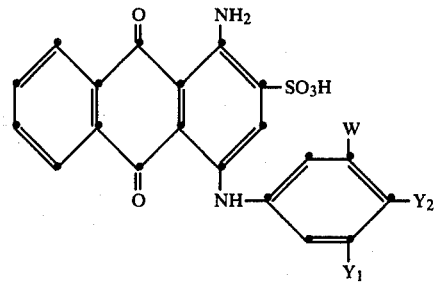

(5)

wherein W is hydrogen or methyl and one of $Y_1$ and $Y_2$ is $C_2$-$C_4$alkanoylamino or $C_2$-$C_4$hydroxyalkylsulfamoyl and the other is hydrogen or methyl; and, in particular, a dye of the formula

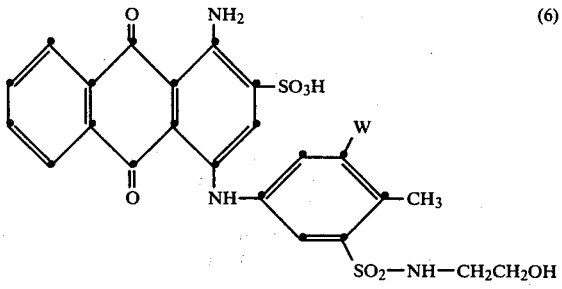

(6)

wherein W is hydrogen or preferably methyl; or a mixture of a dye of the formula (6) and a dye of the formula

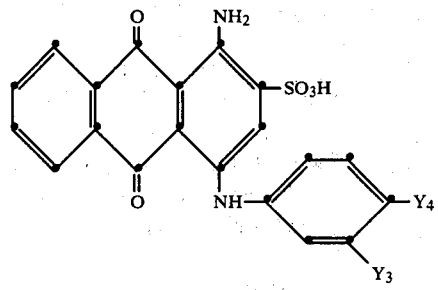

(7)

wherein one of $Y_3$ and $Y_4$ is acetylamino or, preferably, propionylamino, and the other is hydrogen. $Y_3$ is preferably hydrogen and $Y_4$ is above all propionylamino. The dyes of the formulae (5), (6) or (7) are in the form of the free acids or, preferably, of salts, e.g. alkali metal salts or ammonium salts. The ratio of the dye of the formula (6) to that of the formula (7) is advantageously 80:20 to 20:80, preferably 60:40 to 30:70.

Examples of dyes employed in the process of the invention are also described in the Colour Index, 3rd edition, 1971, Vol. 4.

The foamable systems can also be used for whitening undyed fibre materials with fluorescent whitening agents. Depending on the substate, it is possible to use anionic or cationic as well as water-dispersible fluorescent whitening agents. The fluorescent whitening agents can belong to the coumarin, oxazine, naphthalimide, stilbene, styryl, pyrazine, pyrazoline, triazolyl, benzofuranyl, benzoxazolyl, bisbenzoxazolyl, thiophene-bisbenzoxazolyl or benzimidazolyl series.

Suitable fabric finishing agents which can be applied in the process of this invention are all chemical finishing agents which are suitable for use in the textile field, such as conditioning agents, binders, fabric softeners, cleansing agents and sizing agents. It is possible to apply e.g. antistatic agents, flame retardants, water repellents, oil repellents, anticrease agents, easy-care agents, stiffeners, antisoil or soil release agents.

The treatment liquors can also contain conventional additional ingredients, preferably electrolytes such as salts, e.g. sodium sulfate, ammonium sulfate, sodium or ammonium phosphates or polyphosphates, ammonium acetate or sodium acetate and/or acids, e.g. mineral acids such as sulfuric acid or phosphoric acid, or organic acids, preferably lower aliphatic carboxylic acids such as formic, acetic or oxalic acid. The acids are employed principally for adjusting the pH value of the liquors to be used in the process of this invention. Depending on the substrate to be treated, the pH is usually in the range from 4 to 8.

Depending on the desired effect, the treatment liquors can contain still further additional ingredients such as catalysts, urea, oxidants, solvents, retardants, dispersants or emulsifiers.

Preferred assistants are retarders. These are e.g. quaternary ammonium salts which can be obtained, for example, by reaction of aliphatic fatty amines, the alkyl or alkenyl moieties of which contain 8 to 24 carbon atoms, such as dodecylamine, hexadecylamine, heptadecylamine, octadecylamine, tallow fatty amine, arachidylamine, behenylamine or oleylamine, or di- and triamines such as dodecylpropylenediamine, octadecylethylenediamine and octadecyldiethylenetriamine, with 1 to 35 equivalents of an alkylene oxide, e.g. propylene oxide, preferably, however, ethylene oxide, or with a mixture of propylene oxide and ethylene oxide and, if desired, additionally with 1 to 2 equivalents of styrene oxide, and by subsequent reaction with conventional quaternising agents, e.g. methyl, ethyl or benzyl halides, diethyl sulfate and, in particular, dimethyl sulfate, halohydrins, halocarboxylic acid amides, e.g. chloroacetamide.

Mixtures of these cationic assistants can also be used. Particularly suitable retardants are reaction products of adducts of 2 to 35 moles of ethylene oxide with alkylamines or alkenylamines, each of 12 to 24 carbon atoms, or mixtures thereof, which reaction products have been quaternised with dimethyl sulfate, diethyl sulfate, or $C_1$-$C_2$alkyl halides, e.g. methyl chloride or methyl iodide. The retardants are preferably used in an amount of 0.1 to 3 g/l.

The foams are preferably produced by mechanical means using impellers, mixers or also special foam pumps, with which latter the foams can also be produced continuously. In the process of this invention, blow ratios, i.e. volume ratios of foamed to unfoamed composition, of 6:1 to 20:1, preferably 8:1 to 15:1, have proved suitable.

The foams employed in the process of the invention have the property of being thick, dense and stable, i.e. they can be kept and used over a prolonged period of time. The foams preferably have half-lives of 3 to 30 minutes. The bubbles in the foams have diameters from about 1 to 100$\mu$.

The foams can be applied uniformly to the fibrous materials by a wide variety of techniques. Examples of some application methods are: vacuum penetration, rolling on, rolling on/suction, doctor coating with fixed blades or roll coating (on one side or both sides), padding, blowing in, compressing, passing the textile substrate through a chamber which is continuously charged with foam and in which the foam is under a certain pressure. These procedures cause the foam structure to collapse, i.e. the foam decomposes and wets the textile material.

The application of the foam is usually made at room temperature i.e. in the range from about 15° to 30° C. The add-on of foam is normally 10 to 200, in particular 60 to 160% by weight, based on the treated fabric.

For dyeing or treating textiles, a treatment liquor is foamed and the foam is applied from a foam container, preferably with an adjustable doctor blade, from an applicator roll to the face of the fabric. Initially the substrates can be prewetted at room temperature or prewashed or prebulked at temperatures up to 80° C. If desired, the application of foam to the back of the fabric can be repeated, in which case it is not necessary to carry out an intermediate drying between the application to the face of the fabric and the application to the back. It is also possible to apply different treatment liquors to the face and to the back of the textile material.

For treating pile fabrics, e.g. carpets, it can be convenient to pad the substrate, before the foam application, with a pretreatment liquor which preferably contains a nonionic surfactant, e.g. a $C_8$-$C_{22}$fatty acid alkanolamide or an adduct of 1 to 100 moles of ethylene oxide with 1 mole of a $C_8$-$C_{22}$fatty alcohol or of a $C_4$-$C_{16}$alkylphenol or of a $C_8$-$C_{22}$fatty acid, and/or with a dye liquor which preferably contains foaming agents, especially components (A) and (B). The material is preferably impregnated to a pick-up of 40 to 120% by weight. The subsequent add-on of foam is normally 40 to 180% by weight, preferably 50 to 150% by weight. After the substrate has first been padded with an impregnating liquor which may already contain a foaming agent with subsequent add-on of foam, vacuuming the foam into the textile substrate can readily be dispensed with and the heat treatment, preferably by steaming, can be carried out direct.

After the application of foam and the collapse of the foam, the substrate is subjected to a heat treatment, e.g. in the temperature range from 95° to 210° C. The heat treatment can be carried out—after an intermediate drying of the substrate at 80° to 180° C., preferably at 80° to 120° C.,—by thermofixation (dry heat) in the temperature range from 120° to 210° C., preferably from 140° to 180° C. It is preferred to carry out the heat treatment direct, i.e. without an intermediate drying, by steaming at 98° to 120° C., whilst a brief level foam formation takes place on the substrate when it enters the steamer. This foaming lasts about 4 to 25 seconds and prevents undesirable frosting. Depending on the heat development and the temperature range, the heat treatment can take from 30 seconds to 10 minutes. If desired or necessary, the dyes or finishing agents can also be fixed by a chemical bath or a metal bath.

Following the heat treatment the textile material can be given a washing-off in conventional manner in order to remove non-fixed dye or non-fixed finishing agents. This is accomplished by treating the substrate e.g. at 40° to 80° C. in a solution which contains soap or a synthetic detergent.

Level dyeings having good wet- and lightfastness properties or fibrous materials having a good finish are obtained by the process of the invention using foam. In foam dyeing a relatively small amount of moisture is applied in comparison with the conventional continuous methods in which the amount of treatment liquor is up to 500%, based on the substrate, so that a shorter heat treatment and thus a higher productivity rate is possible. In finishing, an improvement in the ratio of obtainable effect (e.g. in resin finishing) to loss in tensile strength is observed in comparison with conventional pad applications. In addition, the wastewater in dyehouses and finishing plants is polluted to only an insignificant degree owing to the small amounts of liquid involved, so that the process of the invention is advantageous from the environmental point of view. The saving in water and energy is also an advantageous consequence of the process of the invention.

In the following Examples percentages are by weight, unless otherwise indicated. The amounts of dye relate to commercially available, i.e. diluted, product, and the amounts of components (A) and (B) relate to pure substance. The following adducts are examples of component (A).

Anionic components (A)

$A_1$ the ammonium salt of the acid sulfuric acid ester of the adduct of 2 moles of ethylene oxide and 1 mole of alfol (1014);

$A_2$ the ammonium salt of the acid sulfuric acid ester of the adduct of 2 moles of ethylene oxide and 1 mole of stearyl alcohol;

$A_3$ the ammonium salt of the acid sulfuric acid ester of the adduct of 3 moles of ethylene oxide and 1 mole of 2-ethylhexanol;

$A_4$ the ammonium salt of the acid sulfuric acid ester of the adduct of 15 moles of ethylene oxide and 1 mole of stearyl alcohol;

$A_5$ the ammonium salt of the acid sulfuric acid ester of the adduct of 3 moles of ethylene oxide and 1 mole of tridecyl alcohol;

$A_6$ the ammonium salt of the acid sulfuric acid ester of the adduct of 4 moles of ethylene oxide and 1 mole of hydroabietyl alcohol;

$A_7$ the ammonium salt of the acid sulfuric acid ester of the adduct of 3 moles of ethylene oxide and 1 mole of alfol (2022);

$A_8$ the ammonium salt of the acid sulfuric acid ester of the adduct of 3 moles of ethylene oxide and 1 mole of lauryl alcohol;

$A_9$ the di-($\beta$-hydroxyethyl)amine salt of the acid sulfuric acid ester of the adduct of 3 moles of ethylene oxide and 1 mole of lauryl alcohol;

$A_{10}$ the sodium salt of the acid sulfuric acid ester of the adduct of 2 moles of ethylene oxide and 1 mole of lauryl alcohol;

$A_{11}$ the sodium salt of the acid sulfuric acid ester of the adduct of 3 moles of ethylene oxide and 1 mole of lauryl alcohol;

$A_{12}$ the acid phosphoric acid ester of the adduct of 5 moles of ethylene oxide and 1 mole of 2-ethyl-n-hexanol;

$A_{13}$ the ammonium salt of the acid sulfuric acid ester of the adduct of 3 moles of ethylene oxide and 1 mole of butylphenol;

$A_{14}$ the ammonium salt of the acid sulfuric acid ester of the adduct of 5 moles of ethylene oxide and 1 mole of tributylphenol;

$A_{15}$ the ammonium salt of the acid sulfuric acid ester of the adduct of 2 moles of ethylene oxide and 1 mole of nonylphenol;

$A_{16}$ the ammonium salt of the acid sulfuric acid ester of the adduct of 10 moles of propylene oxide and 10 moles of ethylene oxide and 1 mole of nonylphenol;

$A_{17}$ the ammonium salt of the acid sulfuric acid ester of the adduct of 35 moles of ethylene oxide and 1 mole of nonylphenol;

$A_{18}$ the ammonium salt of the acid sulfuric acid ester of the adduct of 50 moles of ethylene oxide and 1 mole of nonylphenol;

$A_{19}$ the ammonium salt of the acid sulfuric acid ester of the adduct of 15 moles of propylene oxide and 1 mole of nonylphenol;

$A_{20}$ the ammonium salt of the acid sulfuric acid ester of the adduct of 6 moles of ethylene oxide and 1 mole of dodecylphenol;

$A_{21}$ the ammonium salt of the acid sulfuric acid ester of the adduct of 6 moles of ethylene oxide and 1 mole of pentadecylphenol;

$A_{22}$ the ammonium salt of the acid sulfuric acid ester of the adduct of 8 moles of ethylene oxide and 1 mole of o-phenylphenol;

$A_{23}$ the sodium salt of the acid maleic acid ester of the adduct of 2 moles of ethylene oxide and 1 mole of p-nonylphenol;

$A_{24}$ the sodium salt of the acid monosulfosuccinic acid ester of the adduct of 2 moles of ethylene oxide and 1 mole of p-nonylphenol;

$A_{25}$ the ammonium salt of the acid phosphoric acid ester of the adduct of 2 moles of ethylene oxide and 1 mole of nonylphenol;

$A_{26}$ the acid phosphoric acid ester of the adduct of 10 moles of ethylene oxide and 1 mole of p-nonylphenol;

$A_{27}$ the sodium salt of the acid sulfuric acid ester of the adduct of 15 moles of ethylene oxide and 1 mole of dibenzyl-(nonyl)-phenol;

$A_{28}$ the sodium salt of the acid sulfuric acid ester of the adduct of 12 moles of ethylene oxide and 1 mole of dibenzylphenol.

EXAMPLE 1

A polyamide 66 carpet having a weight of 550 g/m² is continuously prewetted in an aqueous liquor which contains 1 g/l of the adduct of 9 moles of ethylene oxide and 1 mole of nonylphenol, and then centrifuged to a pick-up of 45% by weight.

A dye foam is prepared in a foaming apparatus from an aqueous liquor of the following composition:

0.7 g/l of a dye of the formula (11)

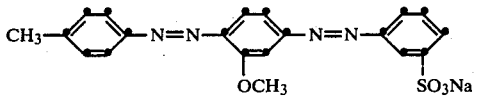

0.05 g/l of a dye of the formula (12)

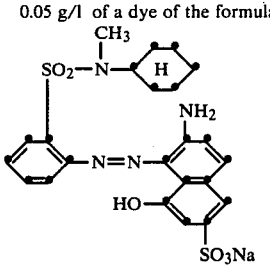

0.04 g/l of a dye of the formula (13)

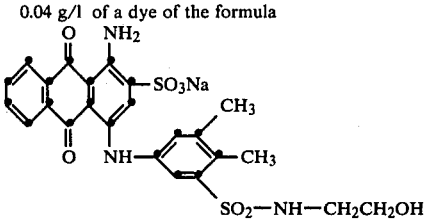

0.7 g/l of the polyadduct of 5 moles of ethylene oxide and 5 moles of propylene oxide with 1 mole of alfol (12–14)
1.25 g/l of component $A_{15}$
1 g/l of sodium acetate, and acetic acid for adjusting the pH of the liquor to 5.8. The blow ratio is 8:1 and the foam has a half life of 5 minutes.

This foam is then applied from a container, equipped with a knife for adjusting the desired thickness of the foam, by means of an applicator roll to the pile side of the carpet, which passes through the dyeing range at a rate of 8 m/minute. The height of the foam is 7 mm and the add-on of foam is 150%.

A vacuum (0.1 bar) is then applied to the back of the carpet in order to effect partial penetration of the layer of foam into the carpet, whereby the height of the foam is somewhat reduced. The carpet then passes over a conveyor roll into a steamer, whilst the layer of foam on the carpet collapses before the carpet reaches the steamer. A further formation of foam, which lasts for 5 to 10 seconds, takes place in the steamer at 98° C. The carpet is subsequently treated with saturated steam for 4 minutes at 98° C., then sprayed with water of 80° C., centrifuged, and dried at 100° C. on a cylindrical drum drier. A level, olive, non-barry dyeing of excellent penetration from the tip of the pile to the carpet backing is obtained.

EXAMPLE 2

800 m² of polyamide 66 carpet having a weight of 680 g/m² are impregnated on a padder to a pick-up of 109% with an aqueous liquor of the following composition:

0.84 g/l of the yellow dye of formula (11),
0.22 g/l of the red dye of formula (12),
0.24 g/l of the blue dye of formula (13),
1.25 g/l of component $A_{15}$
0.5 g/l of the polyadduct of 5 moles of ethylene oxide and 5 moles of propylene oxide with 1 mole of alfol (10–14),
1 g/l of a quaternised adduct of 30 moles of ethylene oxide and 1 mole of $C_{20}$–$C_{22}$ fatty amine,
1 g/l of sodium acetate, and acetic acid for adjusting the pH of the liquor to 6.4.

An aqueous liquor of the following composition is then foamed in the same manner as described in Example 1:

0.84 g/l of a dye of formula (11),
0.22 g/l of a dye of formula (12),
0.25 g/l of a dye of formula (13),
1.25 g/l of component $A_{15}$,
0.5 g/l of the polyadduct of 5 moles of ethylene oxide and 5 moles of propylene oxide with 1 mole of alfol (10–14),
1 g/l of a quaternised adduct of 30 moles of ethylene oxide and 1 mole of a $C_{20}$–$C_{22}$ fatty amine,
1 g/l of sodium acetate, and acetic acid for adjusting the pH of the liquor to 6.4. The blow ratio is 10:1 and the foam has a half life of 5 minutes.

This foam is applied to the pile side of the previously impregnated carpet. The add-on of foam is 85%, based on the weight of the dry carpet. The carpet then travels at a rate of 5 m/minute to a horizontal steamer, where it is treated with saturated steam for 4 minutes at 98° C., and is then rinsed and dried. A beige dyeing of excellent lightfastness and wetfastness properties is obtained.

EXAMPLE 3

800 m² of polyamide carpet having a weight of 680 g/m² are impregnated on a padder to a pick-up of 112% with an aqueous liquor of the following composition:

1.2 g/l of a 1:2 cobalt complex of the dye of the formula (14)

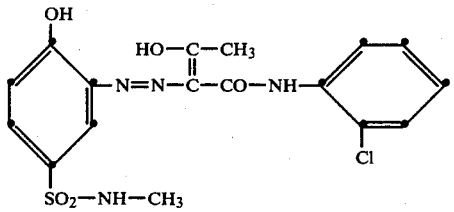

0.17 g/l of a 1:2 cobalt complex of the dye of the formula

-continued

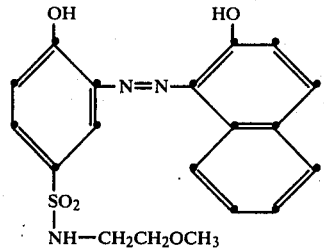

(15)

0.25 g/l of a 1:2 chromium complex of the dye of the formula

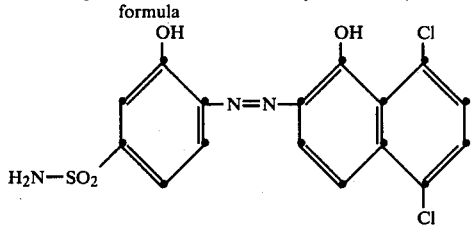

(16)

| | |
|---|---|
| 1.5 g/l | of component $A_{15}$, |
| 1 g/l | of a quaternised adduct of 30 moles of ethylene oxide and 1 mole of a $C_{20}$–$C_{22}$ fatty amine, |
| 0.8 g/l | of the polyadduct of 5 moles of ethylene oxide and 5 moles of propylene oxide with 1 mole of alfol (10–14), and |

acetic acid for adjusting the pH of the liquor to 6.8.

An aqueous liquor of the following composition is then foamed in the same manner as described in Example 1:

| | |
|---|---|
| 1.2 g/l | of a 1:2 cobalt complex of the dye of formula (14), |
| 0.17 g/l | of a 1:2 cobalt complex of the dye of formula (15), |
| 0.25 g/l | of a 1:2 chromium complex of the dye of formula (16), |
| 1.50 g/l | of component $A_{15}$, |
| 0.8 g/l | of the polyadduct of 5 moles of ethylene oxide and 5 moles of propylene oxide with 1 mole of alfol (10–14), |
| 1 g/l | of a quaternised adduct of 30 moles of ethylene oxide and 1 mole of a $C_{20}$–$C_{22}$ fatty amine, |
| 1 g/l | of sodium acetate, and |

acetic acid for adjusting the pH of the liquor to 6.4. The blow ratio is 10:1 and the foam has a half life of 5 minutes.

This foam is applied to the pile side of the previously impregnated carpet. The add-on of foam is 100%, based on the weight of the dry carpet. The carpet then travels at a rate of 12 m/minute to a horizontal steamer, where it is treated with saturated steam for 4 minutes at 98° C., and is then rinsed and dried. A beige dyeing of excellent light-fastness and wetfastness properties is obtained.

EXAMPLE 4

A polyamide 6 carpet having a weight of 720 g/m² is impregnated on a padder to a pick-up of 85% with an aqueous liquor of the following composition:

| | |
|---|---|
| 0.5 g/l | of the yellow dye of formula (11), |
| 0.12 g/l | of the blue dye of formula (13), |
| 1.25 g/l | of component $A_{15}$, |
| 0.7 g/l | of the polyadduct of 9.5 moles of ethylene oxide and 9.5 moles of propylene oxide with 1 mole of nonylphenol, |
| 1 g/l | of sodium acetate, and |

acetic acid for adjusting the pH of the liquor to 7.1.

An aqueous liquor of the following composition is then foamed in the same manner as described in Example 1:

| | |
|---|---|
| 0.5 g/l | of a dye of formula (11), |
| 0.12 g/l | of a dye of formula (13), |
| 1.25 g/l | of component $A_{15}$, |
| 0.7 g/l | of the polyadduct of 9.5 moles of ethylene oxide and 9.5 moles of propylene oxide with 1 mole of nonylphenol, |
| 1 g/l | of sodium acetate, and |

acetic acid for adjusting the pH of the liquor to 7.1. The blow ratio is 8:1 and the foam has a half life of 4½ minutes.

This foam is applied to the pile side of the previously impregnated carpet. The add-on of foam is 90%, based on the weight of the dry carpet. The carpet then travels at a rate of 6 m/minute to a horizontal steamer, where it is treated with saturated steam for 4 minutes at 98° C., then rinsed and dried. A light green dyeing of good light-fastness and wetfastness properties is obtained.

EXAMPLE 5

A polyamide 66 carpet having a weight of 900 g/m² is continuously prewetted in an aqueous liquor which contains 1 g/l of the adduct of 9 moles of ethylene oxide and 1 mole of nonylphenol, and then centrifuged to a pick-up of 45% by weight.

A dye foam is prepared in a foaming apparatus from an aqueous liquor of the following composition:

| | |
|---|---|
| 0.8 g/l | of a dye of formula (11), |
| 0.12 g/l | of a dye of formula (12), |
| 0.6 g/l | of a dye of formula (13), |
| 1.5 g/l | of component $A_{15}$, |
| 1 g/l | of a block polymer of 75 moles of propylene oxide and 25 moles of ethylene oxide, |
| 1 g/l | of sodium acetate, and |

acetic acid for adjusting the pH of the liquor to 5.5. The blow ratio is 11:1 and the foam has a half life of 6 minutes.

This foam is then applied from a container, equipped with a knife for adjusting the desired thickness of the foam, by means of an applicator roll to the pile side of the carpet, which passes through the dyeing range at a rate of 7 m/minute. The height of the foam is 9 mm and the add-on of foam is 138%.

A vacuum (0.1 bar) is then applied to the back of the carpet in order to effect partial penetration of the layer of foam into the carpet, whereby the height of the foam is somewhat reduced. The carpet then passes over a conveyor roll into a steamer, whilst the layer of foam on the carpet collapses before the carpet reaches the steamer. The carpet is subsequently treated with saturated steam for 4 minutes at 98° C., then sprayed with water of 80° C., centrifuged, and dried at 100° C. on a cylindrical drum drier. A beige dyeing of good light-fastness and wetfastness properties is obtained.

EXAMPLE 6

A polyamide 66 carpet having a weight of 1250 g/m² is impregnated on a padder to a pick-up of 55% with an aqueous liquor of the following composition:

| | |
|---|---|
| 1.5 g/l | of the yellow dye of formula (11), |
| 0.7 g/l | of the red dye of formula (12), |
| 1 g/l | of the blue dye of formula (13), |
| 1.5 g/l | of a mixture of the anionic surfactant $A_9$ and coconut fatty acid N,N—bis-(2-hydroxyethylamide) (1:1), |
| 0.7 g/l | of the polyadduct of 5 moles of ethylene oxide and 5 moles of propylene oxide with 1 mole of alfol (10–14), |
| 1 g/l | of sodium acetate, and |

acetic acid for adjusting the pH of the liquor to 6.3.

An aqueous liquor of the following composition is then foamed in the same manner as described in Example 1:

| | |
|---|---|
| 1.5 g/l | of a dye of formula (11), |
| 0.7 g/l | of a dye of formula (12), |
| 1 g/l | of a dye of formula (13), |
| 1.5 g/l | of a mixture of the anionic surfactant $A_9$ and coconut fatty acid N,N—bis-(2-hydroxyethylamide) (1:1), and |
| 0.7 g/l | of the polyadduct of 5 moles of ethylene oxide and 5 moles of propylene oxide with 1 mole of alfol (10–14), |
| 1 g/l | of sodium acetate, and |

acetic acid for adjusting the pH of the liquor to 6.3. The blow ratio is 8:1 and the foam has a half life of 4 minutes.

This foam is then applied to the pile side of the previously impregnated carpet. The add-on of foam is 120%, based on the weight of the dry carpet. The carpet then travels at a rate of 4 m/minute to a horizontal steamer, where it is treated with saturated steam for 4 minutes at 98° C., and is then rinsed and dried. A brown dyeing of good light- and wet-fastness properties is obtained.

EXAMPLE 7

A polyamide 66 carpet having a weight of 520 g/m² is prewetted continuously in an aqueous liquor which contains 1 g/l of the adduct of 9 moles of ethylene oxide and 1 mole of nonylphenol, and centrifuged to a pick-up of 45% by weight.

A dye foam of the following composition is then prepared in a foaming apparatus:

| | |
|---|---|
| 1.2 g/l | of a dye of formula (11), |
| 0.4 g/l | of a dye of formula (12), |
| 1.75 g/l | of component $A_{15}$ |
| 0.5 g/l | of a block polymer of 30 moles of propylene oxide and 5 moles of ethylene oxide, |
| 1 g/l | of sodium acetate, and |

acetic acid for adjusting the pH of the liquor to 6. The blow ratio is 9:1 and the foam has a half life of 5 minutes.

This foam is then applied from a container, equipped with a knife for adjusting the desired thickness of the foam, by means of a roll to the pile side of the carpet, which passes through the dyeing range at a rate of 6 m/minute. The height of the foam is 11 mm and the add-on of foam is 170%.

A vacuum (0.1 bar) is then applied to the back of the carpet in order to effect partial penetration of the layer of foam into the carpet, whereby the height of the foam is somewhat reduced. The carpet then passes over a conveyor roll into a steamer, whilst the layer of foam on the carpet collapses before the carpet reaches the steamer. A further formation of foam, which lasts for 5 to 10 seconds, takes place in the steamer at 98° C. The carpet is subsequently treated with saturated steam for 4 minutes at 98° C., then sprayed with water of 80° C., centrifuged, and dried at 100° C. on a cylindrical drum drier. An orange dyeing of good lightfastness and wetfastness properties is obtained.

EXAMPLE 8

A polyamide 6 carpet having a weight of 570 g/m² is continuously prewashed at 50° C. in an aqueous liquor which contains 1 g/l of an adduct of 9 moles of ethylene oxide and 1 mole of nonylphenol, and centrifuged to a pick-up of 45%.

A dye foam is prepared in a foaming apparatus from an aqueous preparation which contains

| | |
|---|---|
| 1.3 g/l | of the yellow dye of formula (11), |
| 0.2 g/l | of the red dye of formula (12), |
| 1.5 g/l | of the sodium salt of bis-2-ethylhexyl sulfosuccinate, |
| 0.8 g/l | of the polyadduct of 5 moles of ethylene oxide and 5 moles of propylene oxide with 1 mole of alfol (10–14), |
| 1 g/l | of sodium acetate, and |

acetic acid for adjusting the pH of the liquor to 6.5. The blow ratio is 8:1 and the foam has a half life of 4 minutes.

This foam is then applied to the pile side of the previously impregnated carpet as described in Example 1. The speed of the goods is 7 m/minute, the height of the foam is 8 mm, and the add-on of foam is 170%.

The carpet then passes over a conveyor roll to a steamer, whilst the foam on the carpet collapses before the steamer is reached. A further formation of foam, which lasts 5 to 10 seconds, takes place in the steamer at 98° C. The carpet is then treated with saturated steam for 4 minutes at 98° C., then rinsed with water of 80° C., centrifuged, and dried on a cylindrical sieve drier at 100° C. A non-barry orange dyeing of excellent lightness and wetfastness properties is obtained, with penetration of dye from the tip of the pile to the carpet backing.

EXAMPLE 9

A polyamide 66 carpet having a weight of 860 g/m² is pretreated as described in Example 8. An aqueous liquor of the following composition is then foamed as described in Example 1:

1.35 g/l of a blue dyestuff mixture (1:1) consisting of a dye of formula (13) and a dye of the formula

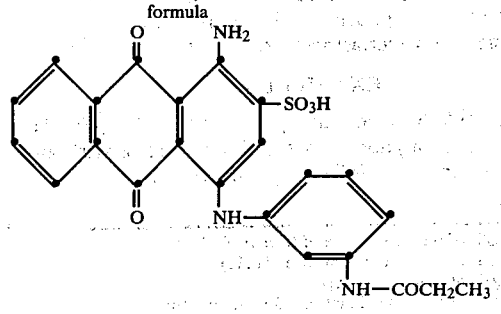

(17)

-continued

| | | |
|---|---|---|
| 0.05 | g/l | of a dye of formula (11), |
| 1.1 | g/l | of component $A_{12}$, |
| 1.5 | g/l | of component $A_{15}$, |
| 0.7 | g/l | of the polyadduct of 5 moles of ethylene oxide and 5 moles of propylene oxide with 1 mole of alfol (10–14), |
| 1 | g/l | of sodium acetate, and |

acetic acid for adjusting the pH of the liquor to 6.1. The blow ratio is 8:1 and the foam as a half life of 5 minutes.

This foam is then applied to the pile side of the previously impregnated carpet to an add-on of 145%, based on the weight of the dry carpet. The height of the foam is 9 mm. The carpet then travels at a rate of 8 m/minute to a horizontal steamer, where it is treated with saturated steam for 4 minutes at 98° C., and is then rinsed and dried. A level blue dyeing of good light- and wetfastness properties is obtained.

A level blue dyeing is also obtained by using, instead of 1.35 g/l of the blue mixture, 1.35 g/l of another blue mixture consisting of 56 parts of the dye of formula (13) and 44 parts of a dye of the formula

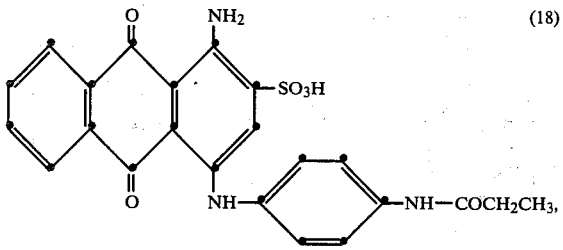

(18)

and otherwise repeating the above procedure.

EXAMPLE 10

A polyamide 66 carpet having a weight of 520 g/m$^2$ is pretreated as described in Example 8. An aqueous liquor of the following composition is then foamed:

| | | |
|---|---|---|
| 0.65 | g/l | of a dye of formula (15), |
| 0.12 | g/l | of a dye of formula (16), |
| 2 | g/l | of component $A_8$, |
| 0.6 | g/l | of the polyadduct of 5 moles of ethylene oxide and 5 moles of propylene oxide with 1 mole of alfol (10–14), |
| 1 | g/l | of an ammonium salt of the adduct of 30 moles of ethylene oxide and 1 mole of a $C_{20}$–$C_{22}$ fatty amine, which salt has been obtained by quaternising with dimethyl sulfate, |
| 1 | g/l | of sodium acetate, and |

This foam is applied to the pile side of the previously impregnated carpet. The add-on is 160%, based on the weight of the dry carpet. The height of the foam is 9 mm. The carpet then travels at a rate of 6 m/minute to a horizontal steamer, where it is treated with saturated steam for 4 minutes at 98° C., and is then rinsed and dried. A claret dyeing of good light- and wetfastness properties is obtained.

EXAMPLE 11

A wool cut-pile carpet having a weight of 1150 g/m$^2$ is impregnated on a padder to a pick-up of 80% with an aqueous liquor of the following composition:

| | | |
|---|---|---|
| 1 | g/l | of a urea derivative moth repellent, |
| 1.3 | g/l | of a dye of formula (11), |
| 0.2 | g/l | of a dye of formula (13), |
| 1.3 | g/l | of component $A_{15}$, |
| 0.6 | g/l | of the polyadduct of 5 moles of ethylene oxide and 5 moles of propylene oxide with 1 mole of alfol (10–14), |
| 1 | g/l | of sodium acetate, and |

acetic acid for adjusting the pH of the liquor to 5.8. An aqueous liquor which also contains the above ingredients is then foamed as described in Example 1. The blow ratio is 9:1 and the foam has a half life of 5 minutes.

This foam is applied to the pile side of the previously impregnated carpet. The add-on of foam is 70%, based on the weight of the dry carpet. The carpet then travels at a rate of 10 m/minute to a horizontal steamer, where it is treated with saturated steam for 4 minutes at 98° C., and is then rinsed and dried. The carpet is dyed in a light-green shade of good wetfastness and lightfastness properties and has an excellent moth-resistant finish.

EXAMPLE 12

A cotton boucle carpet having a weight of 720 g/m$^2$ is impregnated on a padder to a pick-up of 70% with an aqueous preparation of the following composition:

6.5 g/l of a dye of the formula

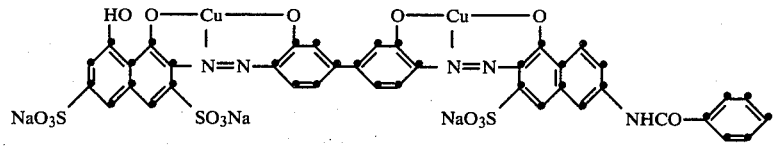

(19)

| | | |
|---|---|---|
| 3 | g/l | of component $A_{15}$. |
| 1 | g/l | of the sodium salt of bis-octyl sulfosuccinate, |
| 1 | g/l | of a polyadduct of 5 moles of ethylene oxide and 5 moles of propylene oxide with 1 mole of alfol (10–14). |

acetic acid for adjusting the pH of the liquor to 6.8. The blow ratio is 10:1 and the foam has a half life of 6 minutes.

An aqueous liquor which also contains the above ingredients is then foamed as described in Example 1. The blow ratio is 9:1 and the foam has a half life of 6 minutes.

This foam is applied to the pile side of the previously impregnated carpet. The add-on of foam is 75%, based on the weight of the dry carpet. The carpet then travels at a rate of 6 m/minute to a horizontal steamer, where it is treated with saturated steam for 7 minutes at 98° C., and is then rinsed and dried. A blue dyeing with good penetration of the loops and of good wetfastness and light-fastness properties is obtained.

EXAMPLE 13

A wool cut-pile carpet having a weight of 1150 g/m$^2$ is continuously prewetted in an aqueous liquor which contains 2 g/l of the sodium salt of bis-octylsulfosuccinate, and centrifuged to a pick-up of 40% by weight.

A dye foam of the following composition is then prepared in a foaming apparatus:

2.4 g/l of a dye of the formula (20)

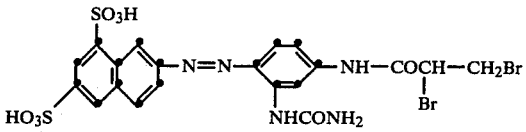

4.5 g/l of a dye of the formula (21)

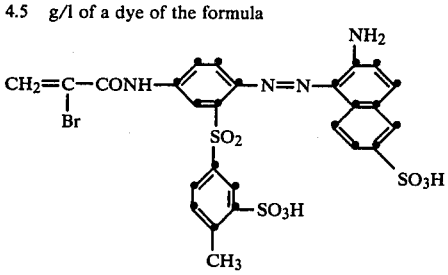

1 g/l of a dye of the formula (22)

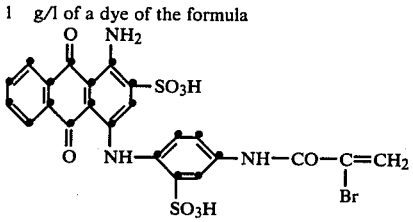

2 g/l of component $A_{15}$,
1.5 g/l of the polyadduct of 9.5 moles of ethylene oxide and 9.5 moles of propylene oxide with 1 mole of a $C_{12}$–$C_{14}$ fatty alcohol, and acetic acid for adjusting the pH of the liquor to 4. The blow ratio is 8:1 and the foam has a half life of 5 minutes.

This foam is then applied from a container, equipped with a knife for adjusting the desired thickness of the foam, by means of an applicator roll to the pile side of the carpet, which passes through the dyeing range at a rate of 8 m/minute. The height of the foam is 7 mm and the add-on of foam is 150%.

A vacuum (0.1 bar) is then applied to the back of the carpet in order to effect partial penetration of the layer of foam into the carpet, whereby the height of the foam is somewhat reduced. The carpet then passes over a conveyor roll into a steamer, whilst the layer of foam on the carpet collapses before the carpet reaches the steamer. A further formation of foam, which lasts for 5 to 10 seconds, takes place in the steamer at 98° C. The carpet is subsequently treated with saturated steam for 5 minutes at 98° C., then washed cold and dried. A level brown dyeing of excellent penetration is obtained.

A level brown dyeing is also obtained by using, instead of the indicated dyes, 3.5 g/l of a 1:2 chromium mixed complex comprising a dye of each of the formulae (23)

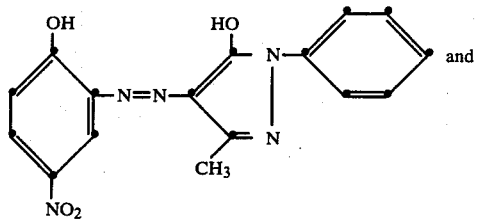

and (24)

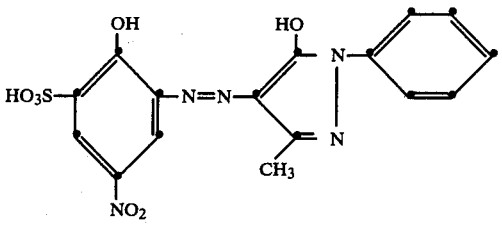

0.25 g/l of a 1:2 chromium mixed complex comprising a dye of each of the formulae (25)

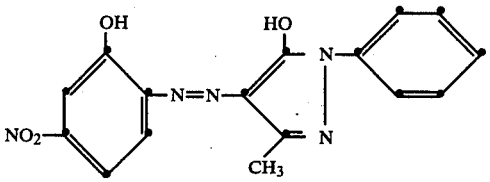

and (24)

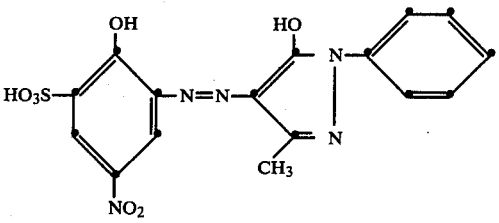

and 2.25 g/l of a 1:2 chromium mixed complex comprising a dye of each of the formulae (26)

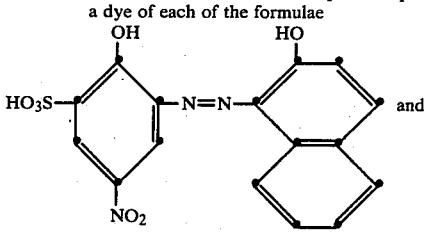

and (23)

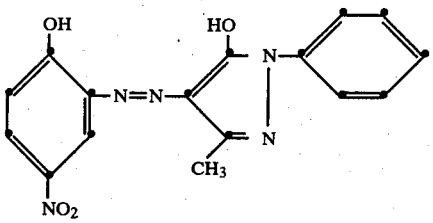

EXAMPLE 14

A polyamide 66 carpet fabric having a weight of 550 g/m$^2$ is continuously prewetted in an aqueous liquor which contains 1 g/l of the adduct of 9 moles of ethylene oxide and 1 mole of nonylphenol, and centrifuged to a pick-up of 45% by weight. A dye foam of the following composition is then prepared in a foaming apparatus:

| | | |
|---|---|---|
| 0.7 | g/l | of the yellow dye of formula (11), |
| 0.05 | g/l | of the red dye of formula (12), |
| 0.4 | g/l | of a blue dyestuff mixture consisting of 30.2 parts of the dye of formula (13) and 69.8 parts of the dye of formula (18), |
| 0.7 | g/l | of the polyadduct of 5 moles of ethylene oxide and 5 moles of propylene oxide with 1 mole of a $C_{12}$–$C_{14}$ fatty alcohol, |
| 1.25 | g/l | of the ammonium salt of the acid sulfuric acid ester of the adduct of 2 moles of ethylene oxide and 1 mole of nonylphenol (component $A_{15}$), |
| 1 | g/l | of sodium acetate, and |

acetic acid for adjusting the pH of the liquor to 5.8. The blow ratio is 8:1 and the foam has a half life of 5 minutes.

This foam is then applied from a container, equipped with a knife for adjusting the desired thickness of the foam, by means of an applicator roll to the pile side of the carpet, which passes through the dyeing range at a rate of 8 m/minute. The height of the foam is 7 mm and the add-on of foam is 150%.

A vacuum (0.1 bar) is then applied to the back of the carpet in order to effect partial penetration of the layer of foam into the carpet, whereby the height of the foam is somewhat reduced. The carpet then passes over a conveyor roll into a steamer, whilst the layer of foam on the carpet collapses before the carpet reaches the steamer. A further formation of foam, which lasts for 5 to 10 seconds, takes place in the steamer at 98° C. The carpet is subsequently treated with saturated steam for 4 minutes at 98° C., then sprayed with water of 80° C., centrifuged, and dried at 100° C. on a cylindrical drum drier. A level, olive, non-barry dyeing of excellent penetration from the tip of the pile to the carpet backing is obtained.

A level, non-barry olive dyeing with excellent penetration of dye from the tip of the pile to the carpet backing is also obtained by using, instead of 0.4 g/l of the above blue dyestuff mixture, 0.4 g/l of a blue dyestuff mixture consisting of

| | |
|---|---|
| 56.6 | parts of the dye of formula (13) and |
| 43.4 | parts of the dye of formula (18) or |
| 0.4 | g/l of a third dyestuff mixture consisting of |
| 52 | parts of the dye of formulas (13) and |
| 48 | parts of the dye of formula (17), |

and otherwise carrying out the procedure of this Example.

What is claimed is:

1. A process for dyeing or finishing textile material using foam, which process comprises applying to said material an aqueous foam composition which, in addition to containing dye or finishing agent, contains a foamable system comprising water and (A) an anionic surfactant and (B) a non-ionic block polymer based on ethylene oxide and propylene oxide units of the formula $$R_3-O-(CH_2CH_2-O)_{n1}-(\underset{Z_1}{CH}-\underset{Z_2}{CH}-O)_y-(CH_2CH_2-O)_{n2}-H$$

wherein $R_3$ is alkyl or alkenyl each of 8 to 16 carbon atoms, one of $Z_1$ and $Z_2$ is hydrogen and the other is methyl, y is 3 to 50, $n_1$ is 1 or greater, $n_2$ is zero or greater and the sum $n_1+n_2$ is 3 to 15, and subsequently subjecting the textile material to a heat treatment.

2. A process according to claim 1, wherein the anionic surfactant is an acid ester, or salt thereof, of a polyadduct of 2 to 30 moles of ethylene and 1 mole of a fatty alcohol of 8 to 22 carbon atoms or 1 mole of a phenol which contains at least one benzyl group, one phenyl group or one alkyl group of at least 4 carbon atoms, which acid ester is used individually or in admixture.

3. A process according to claim 2, wherein the anionic surfactant is a compound of the formula $$R-O-(CH_2CH_2O)_m-X \quad (1)$$

wherein R is alkyl or alkenyl, each of 8 to 22 carbon atoms, alkylphenyl containing 4 to 16 carbon atoms in the alkyl moiety, or o-phenylphenyl, X is the acid radical of an inorganic oxygen-containing acid or the radical of an organic acid, and m is 2 to 30, and the surfactant is in the form of the free acid, alkali metal salt, ammonium salt or amine salt.

4. A process according to claim 3, wherein the anionic surfactant is a compound of the formula

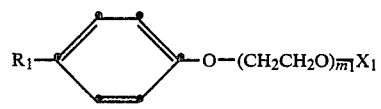

wherein $R_1$ is octyl or nonyl, $m_1$ is 2 to 5 and $X_1$ is derived from o-phosphoric acid or from sulfuric acid, and the surfactant is in the form of the free acid or sodium or ammonium salt.

5. A process according to claim 1, wherein component (B) is a block polymer having a cloud point of 15° to 70° C.

6. A process according to claim 5, wherein the block polymer has a cloud point of 25° to 50° C.

7. A process according to claim 1, wherein the block polymer is composed of 10 to 50% by weight of ethylene oxide and 50 to 90% by weight of propylene oxide and has a molecular weight of 350 to 3000.

8. A process according to claim 1, wherein the block polymer is an adduct of 3 to 10 moles of ethylene oxide and 3 to 10 moles of propylene oxide with an aliphatic monoalcohol of 8 to 16 carbon atoms.

9. A process according to claim 1, wherein the foamable system comprises at least (Aa) a sulfuric acid ester, or a salt thereof, of an adduct of 2 to 15 moles of ethylene oxide with 1 mole of an aliphatic monoalcohol containing 8 to 18 carbon atoms or, with 1 mole of an alkylphenol containing 4 to 12 carbon atoms in the alkyl moiety, and (Bb) a polyadduct of 3 to 10 moles of ethylene oxide and 3 to 10 moles of propylene oxide with 1 mole of an aliphatic monoalcohol containing 8 to 16 carbon atoms.

10. A process according to claim 1, wherein the foamable system comprises 5 to 60% by weight of component (A), 5 to 30% by weight of component (B), and 10 to 90% by weight of water, based on the weight of the entire system.

11. A process according to claim 1, wherein the foamable system additionally contains a retardant.

12. A process according to claim 11, wherein the retardant is a quaternary ammonium salt which has been obtained by addition of 1 to 35 moles of an alkylene oxide to an aliphatic amine which contains an alkyl or alkenyl radical, each of 8 to 24 carbon atoms, and by subsequent reaction of the adduct with a quaternising agent.

13. A process according to claim 11, wherein the retardant is a quaternary ammonium salt which has been obtained by addition of 1 to 35 moles of an alkylene oxide and 1 or 2 moles of styrene oxide to an aliphatic amine which contains an alkyl or alkenyl radical, each of 8 to 24 carbon atoms, and by subsequent reaction of the adduct with a quaternising agent.

14. A process according to claim 1, wherein the foamed treatment liquor is applied from an applicator roll continuously to the textile material, and the material is subjected to a heat treatment after the foam has collapsed, with or without drying.

15. A process according to claim 1, wherein the foamed composition is applied in succession to both sides of the textile material.

16. A process according to claim 1, wherein the heat treatment is carried out by steaming the textile material in the temperature range from 95° to 120° C.

17. A process according to claim 1, which comprises applying a foamed dye composition from an applicator roll continuously, in the form of at least one layer, to the textile material, applying a vacuum to effect sufficient penetration of foam into the material such that the layer of foam remaining on the surface thereof is reduced in height, and subsequently steaming the material.

18. A process according to claim 17, which comprises applying a first layer of foam to the pile side of a carpet, vacuuming said layer of foam into the carpet, then applying a second layer of foam and subsequently steaming the carpet.

19. A process according to claim 1, which comprises impregnating a carpet with an aqueous treatment liquor or an aqueous dye liquor, then applying the foamed composition and fixing the dyeing by steaming.

20. A process according to claim 19, wherein the dye liquor also contains components (A) and (B).

21. A process according to claim 19, wherein the pretreatment liquor contains a non-ionic surfactant.

22. A process according to claim 1, wherein at least two or three anionic dyes are used for dyeing a polyamide carpet.

23. A process according to claim 22, wherein a yellow or orange dye, a red dye and a blue dye are used to obtain a trichromatic dyeing.

24. A foamed aqueous composition which contains at least one dye or one finishing agent, and a foamable system comprising water and at least (A) one anionic surfactant and (B) one non-ionic block polymer which is based on ethylene oxide and propylene oxide units.

25. An aqueous foamable system comprising water and at least (A) one anionic surfactant and (B) one non-ionic block polymer based on ethylene oxide and propylene oxide units.

26. The process of claim 1, wherein y is 3 to 15, $n_1$ is 3 to 15 and $n_2$ is zero.

27. The process of claim 1, comprising the further step of drying the textile material before the heat treatment.

* * * * *